United States Patent [19]

Beck

[11] 4,416,919

[45] Nov. 22, 1983

[54] METHOD AND AN APPARATUS FOR REMOVING THICKENINGS IN COATINGS OCCURRING TRANSVERSELY TO THE DIRECTION OF TRAVEL OF THE WEB

[75] Inventor: Wilfried Beck, Cologne, Fed. Rep. of Germany

[73] Assignee: Agfa-Gevaert Aktiengesellschaft, Leverkusen-Bayerwerk, Fed. Rep. of Germany

[21] Appl. No.: 263,282

[22] Filed: May 13, 1981

[30] Foreign Application Priority Data

May 21, 1980 [DE] Fed. Rep. of Germany ..... 3019459

[51] Int. Cl.[3] ..... B05C 11/06

[52] U.S. Cl. ..... 427/296; 427/348; 118/50; 118/63; 118/672; 430/935

[58] Field of Search ..... 118/63, 50, 62, 672; 427/348, 349, 296; 430/935

[56] References Cited

U.S. PATENT DOCUMENTS 2,679,231 5/1954 Pomper et al. ..... 118/63
3,499,418 3/1970 Mayhew ..... 118/672
3,550,553 12/1970 Mahoney ..... 118/63
3,607,366 9/1971 Kurokawa ..... 427/349
3,871,326 3/1975 Kanda ..... 118/63

*Primary Examiner*—Ralph S. Kendall
*Attorney, Agent, or Firm*—Connolly and Hutz

[57] ABSTRACT

The invention relates to an apparatus and to a method for removing thickenings in layers which are produced transversely to the direction of travel of the web after the coating of continuously moving webs with liquids whereby the coated web is deflected by a web guide element and two air jets pointing towards each other are directed to a small angle $\alpha$ towards the layer of the web from below the deflecting point as air blades which are actuated when thickenings appear in the layer and which scrape off the particles of the thickening and blow them into a vacuum tank which is sprinkled all over with water and the water and particles are supplied to a vacuum generating device which, in turn, is evacuated by a jet suction device without interrupting the vacuum.

9 Claims, 2 Drawing Figures

METHOD AND AN APPARATUS FOR REMOVING THICKENINGS IN COATINGS OCCURRING TRANSVERSELY TO THE DIRECTION OF TRAVEL OF THE WEB

The invention relates to an apparatus and a method for removing thickened layers occurring transversely to the direction of travel of the web after the coating of continuously moving webs with liquids, in particular when coating photographic film and paper webs with photographic emulsions and layers.

When coating webs with liquids, for example with viscous, aqueous or organic solutions or with photographic gelatin silver halide emulsions or the like, thickened layers are produced due to an accumulation of layer material as the coating devices are set in position (immersion) and as the coating devices are removed (emergence) or at adhesive points and thickenings in the web. These thickened layers extend transversely to the direction of travel of the web, usually over the entire width of the web. At the beginning of the coating operation, the immersion bead is thus formed by an excess of coating solution which disintegrates fairly quickly depending on the coating device and passes into an equilibrium condition of the application mechanism with a constant layer thickness.

At the end of the coating operation, the path of the emergence bead is formed as the layer is separated from the substrate and also extends as a thickening over the entire width of the web and then dissolves into "coating droplets".

In order to connect the webs to a strip which is to be endlessly coated, the ends of the web are spliced using adhesive tape. The adhesive tape produces a thickening in the web which impairs the layer application mechanism and causes the layer to become thick and thin until the equilibrium is once more achieved. Coating defects produced by external action or partial thickenings in the web to be coated cause thickenings in the layers during the coating operation.

These thickenings can be as much as two to four times the normal thickness of the layer. However, before a coated web can be wound up, the web must be completely dry at all points, including the thickened points. If the thickened points are not completely dry, they cause the windings of the wound web to stick together so that it is impossible to unwind the web or so that the web tears when it is unwound.

A considerably greater drying capacity is required to dry the thickened points of the web than for the normal layer thickness. This capacity can only be provided if the drying stretch is lengthened, which leads to high investment costs, or by reducing the coating speed, which leads to a loss in production and to a loss of energy. The complete drying of the thickened layer produces the additional disadvantage of the drop in quality of the normal layer as it is over-dried and may become cracked, brittle or, in the case of photographic material, foggy.

Even if the thickened layers are completely dried and wound into a roll, pressures due to the winding pressure are exerted on the next and the preceding windings of the roll which often make large portions of a roll unserviceable if the layers are pressure-sensitive.

Practical attempts have therefore been made, using a wide variety of methods and apparatuses, to find a means of reducing or, if possible, completely avoiding these thickened layers.

A method is known from U.S. Pat. No. 4,154,612 in which the coated web is initially dried in the conventional manner in such a way that the normal layer is dry and the coated web is then exposed to a microwave drying treatment which preferably completely dries the thickenings in the web and spares the normal layer containing less residual moisture. Although a proportion of the energy can be saved by this method since subsequent drying is only carried out at the points with thickened layers, the thickenings are not eliminated so they still lead to impressions in or pressures on the web. Furthermore, only a slight reduction in the drying stretch or a slight increase in speed is possible with this method, as microwave drying operations also require space.

In order to reduce the thickened layer, it is known from British Pat. No. 1,243,663 to moisten the points at which bonds occur, particularly at adhesive points, in order to distribute the thickenings. However, this measure has only limited success as the thickenings are not levelled to a significant extent. Attempts have also been made to control the casting device so as to avoid thickening of the layers when passing through a thickening in the web. This is to be achieved by increasing the vacuum beneath the casting device just before passage of the thickening and normalizing it again just after passage thereof (U.S. Pat. No. 3,916,043). On the one hand, only a slight improvement is achieved by this method and, on the other hand, the method can only be adopted with specific casting devices.

An object of the invention is therefore to find an apparatus and a method which allow the thickenings in the layers transversely to the direction of travel of the web to be removed completely and the particles of the thickenings to be collected and discharged together, without the web and the normal coating(s) of the web being contacted or damaged.

The object has been achieved according to the invention in that a deflecting element for deflecting the web is arranged downstream of the coating device for the web, in that an air blade directed at a low angle to the layer of the web is provided on the approach side and the delivery side of the web to and from the deflecting element respectively, extends over the entire width of the web and is pivotal about an axis, and in that there is provided beneath the air blades a vacuum tank into which the blown-off particles of layer can be drawn and from which the particles can be discharged.

Surprisingly for the skilled man, it has been found that the air blades enable the entire thickened layers to be sheared completely from the web and blown into the vacuum tank. This is even possible if the standard casting of the web has dried sufficiently to prevent the standard layer from being damaged. Several solidified thickenings can be sheared off by the air blades. This permits the productivity of the entire coating installation to be increased by from 20 to 40% with an equally long drying stretch or, with the same productivity and slower drying, permits a corresponding quantity of energy to be saved as well as more careful drying of the layer(s) to be carried out and the quality of the product thus to be improved. Once the thickenings in the layer(s) have been sheared off, the web can be wound up after the standard layer(s) has dried without impressions or pressures occurring. The points in the web which had thickenings then dry sooner than the standard layer, so over-drying of these points has to be taken into consideration as these short lengths of web without a layer ar unusable and are removed with minimal losses in a subsequent operation.

An advantageous embodiment of the apparatus is distinguished in that a distributing groove with bores and a water connection is arranged round the upper rim of the vacuum tank in order to sprinkle the surface and to spray the volume of the vacuum tank. This has the advantage that the sheared-off portions of the thickened layer impinge upon a water film as they enter the vacuum tank and are carried off on it without having the opportunity of settling.

In a preferred embodiment, the air blades, the water flushing of the vacuum tank and the vacuum tank are actuated via a web tracking programme so that the apparatus can be switched on immediately upstream of the web thickening transversely to the direction of travel of the web and can be switched off immediately downstream of the end of the thickening.

A suitable design is distinguished in that the web tracking programme and the switching on of the apparatus can be controlled by means of the moment and the duration of the immersion and emergence of the coating device. This simple method can be adopted whenever there are identical conditions in the coating device and whenever the length and breadth of a thickened layer being formed is reliably known. In another suitable device, the web tracking programme and the switching on of the apparatus can be controlled by means of a moisture content or web thickness measuring device arranged upstream of the apparatus.

It has also been found that it is advantageous if the vacuum in the vacuum tank and the water supply can be switched on simultaneously with the air blades and switched off with a time delay after the air blades have been switched off and pivoted away.

Another surprising advantage lies in the connection of the vacuum tank to a vacuum generating device which, in turn, can be evacuated by means of a jet suction device without interrupting the vacuum. Due to this measure, the apparatus is always ready for operation and the coating installation need not be stopped in order to evacuate the vacuum generating device.

It has also been found that it is advantageous to arrange the apparatus for removing the thickenings in the web at a distance downstream of the coating point at which the standard coating is already dried.

The invention also relates to a method of the type mentioned at the outset, which is distinguished in that the coated web is deflected by a web guide element and two air jets pointing towards each other are directed from below towards the web layer on the deflecting side as air blades which are actuated when thickened layers appear and scrape off the particles of the thickened layer and blow them into a vacuum tank which is sprinkled all over with water, which receives the particles, and the mixture of air, water and particles of the thickened layer is supplied to a vacuum generating device which, in turn, is evacuated continuously by a jet suction device without interrupting the vacuum.

The method can be carried out particularly advantageously if the air blades for scraping the thickened layer are controlled being brought to the web deflecting point just before the appearance of the thickening and set into operation, wherein the vacuum tank is simultaneously provided with a vacuum and water sprinkling, the web is then completely freed from the entire coating in the region of the thickening in the layer and, after the end of the thickening in the layer, first the air blades are switched off and removed from the web and then the vacuum and the water sprinkling are switched off after a time delay.

An embodiment of the invention is described in more detail below with reference to drawings.

Figure 1:
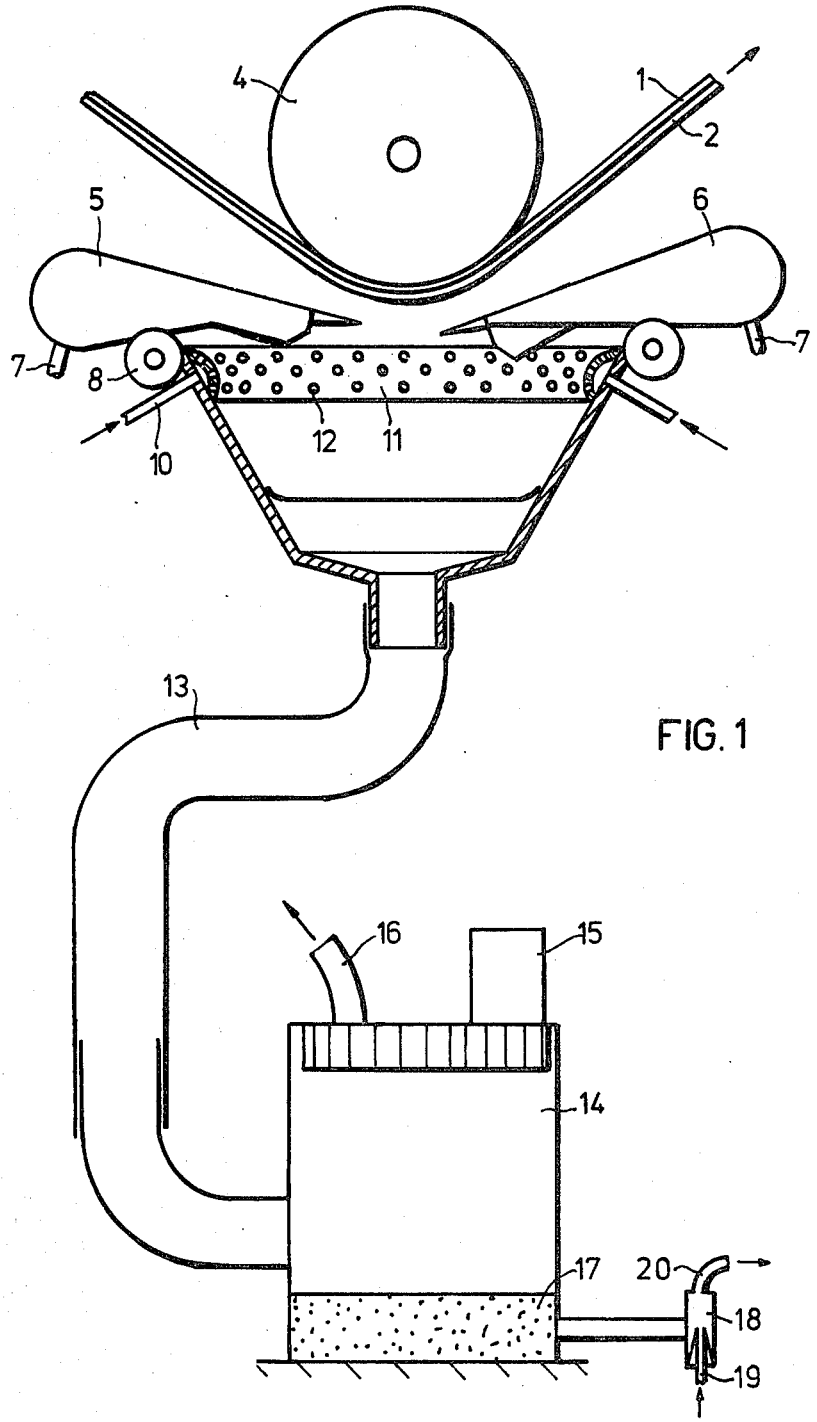
FIG. 1 shows a side view of the apparatus in the rest position.

FIG. 1 shows an exemplary embodiment of the apparatus. The web provided with a layer 2 is deflected by means of a deflecting element 4, for example, round a roller. Two air blades 5,6 are arranged pivotally about axes 8 below the web. The air blades 5,6 are specially shaped air nozzles with air connections 7 through which the air issues at high speed along blade-shaped cutting edges. The air pressure with which the air blades 5,6 are charged is at from 0.5 to 6 bar but an air pressure of from 0.5 to 3 bar is generally sufficient. In the rest position, the air blades 5,6 are pivoted away from the web 1 in order to avoid damaging or disturbing the layer 2 of the web 1. A rectangular vacuum tank 9 extending over the entire width of the web 1 and somewhat beyond, is arranged beneath the air blades 5,6. The tank 9 is surrounded by a channel 11 with water connections 10 for sprinkling and spraying the tank chamber. The channel 11 has bores 12 from which the water is sprayed under pressure into the vacuum chamber when the apparatus is switched on and is guided along the walls of the tank 9. The tank 9 is connected to a vacuum generating device 14, for example, an industrial vacuum cleaner, by a pipe line or a tube 13. The mixture of water and particles 17 settles in the vacuum generating device 14 while the air is separated by the driving mechanism 15 and blown out.

In order to permit continuous operation of the apparatus, the mixture 17 is continuously drawn from the vacuum generating device 14 by means of a jet suction device 18. The jet suction device 18 is charged via a connection 19 with water or air and conveys the mixture 17 to an outlet 20 or to a recovery installation (not shown) if the particles of layer are composed of valuable material, for example, silver halide emulsions.

Figure 2:
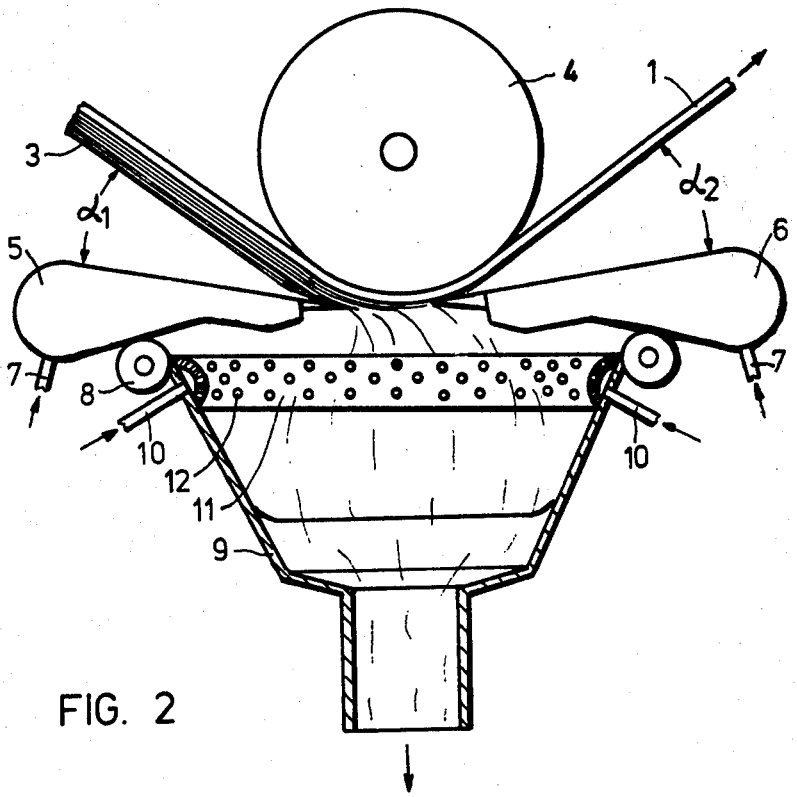
FIG. 2 shows a side view of the apparatus in the operating position.

FIG. 2 shows the apparatus in operation. The blades 5,6 are pivoted upwards towards the web 1 to form an angle $\alpha$ just before a thickening 3 in the layer enters the apparatus. In this case, the angle $\alpha_1$ between the air blade 5 and the web 1 is somewhat smaller than the angle $\alpha_2$ to enable the thickened edge 3 to enter the region of the apparatus without obstruction and to prevent layer material from settling on the air blade 5.

The air blade 6 is pivoted from the angle $\alpha_2$ directly on to the web 1 and the compressed air is supplied to the two air blades 5,6 through the connections 7. Simultaneously with the air pressure for the air blades 5,6, the vacuum in the vacuum tank 9 is built up and water under excess pressure to forced through the connections 10 into the distributing groove. The air blades 5,6 scrape all layer material 2,3 from the web 1 and blow the particles of layer material 2,3 into the vacuum tank 9. The particles are sprayed with water, and mixed therein and are carried off by the vacuum in the tank 9 in the manner already described above. Due to the advantageous sprinkling and spraying of the tank chamber, all particles are carried off perfectly without being able to settle at any point of the tank 9.

The air blades 5,6 are switched off just after the end of the thickening 3 in the layer and are pivoted away from the web 1. After a time delay of several seconds, the vacuum in the tank 9 and the water supply 10 are switched off. Due to this delay in switching them off, the tank 9 continues to be flushed in order to carry away the last particles and to prevent the particles from settling.

As already mentioned, the air blades 5,6 allow the thickened layer 2 still containing a considerable proportion of free water to be scraped off perfectly as a doughy mass from the web, but not a layer 2 which no longer contains any free water after the first physical drying section. In order to avoid unnecessary scraping of layer material, the apparatus is advantageously arranged at a point downstream of the coating device at which the standard layer 2 no longer contains any free water and can no longer be scraped by the air blades 5,6.

If several layers are brought in succession after the respective drying treatments to the first physical drying section, the apparatus surprisingly only needs to be used after the first drying treatment of the last layer applied. The thickening 3 in the layer is re-moistened by the next respective layer and maintains its doughy condition which allows all layers to be removed at once after application of the last layer.

The apparatus can be switched on and off from the coating point, and the immersion and emergence of the coating device can be used for controlling the apparatus. The immersion time is recorded and the apparatus is switched on via a web tracking programme whenever the immersion point passes just in front of the apparatus. The time is also recorded upon emergence, a stabilisation time for the coating device is added and the apparatus is switched off via the web tracking programme when the end of the thickening has passed the apparatus.

Thickenings 3 in the layers 2 can however also be determined by measurement and used for switching the apparatus on and off. For this purpose, either the thickness of the layer or the moisture of the layer 2 is measured upstream of the apparatus. If the measured values exceed a set value, the apparatus is switched on after a delay corresponding to the distance between the measuring point and the apparatus (web tracking programme) and switched off again after a delay once the set value has again been attained.

The apparatus and the method are distinguished by simple and reliable operation. Damage to the web and to the layers thereof are avoided. Using the apparatus, it is surprisingly possible to perfectly remove all thickenings in layers which are produced by the immersion and emergence process, by adhesive points or other thickenings in the web, and to remove the scraped off particles of layer reliably and continuously. By using the apparatus or by adopting the method it is possible to reduce the drying times for coated webs by from 20 to 40% so that a considerable saving can be made in energy, based on the web length. This allows more web material to be produced at higher speed or allows drying to be carried out more slowly and the quality therefore to be improved in an existing coating installation.

I claim:

1. An apparatus for removing thickenings in layers which are produced transversely to the direction of travel of a web during the coating of photographic film and paper webs with photographic emulsions and layers by means of air blade and air jet and carry out the excess coating material by means of vacuum and water flushing, characterized in that a deflecting element for deflecting the web is arranged downstream of the coating device for the web at a distance from the coating point at which the normal coating is already dry, in that two air blades and air jets pointing toward each other at angles $\alpha_1$, $\alpha_2$, to the layer of the web are provided on the approach side and the delivery side of the web to and from the deflecting element respectively and extends over the entire width of the web and is pivotal about an axis and in that there is provided beneath the air blades a vacuum tank into which the blown-off particles of layer can be drawn and from which the particles can be discharged.

2. An apparatus according to claim 1, characterised in that a distributing groove with bores and a water flushing is arranged round the upper rim of the vacuum tank to sprinkle the surface and spray the volume of the vacuum tank.

3. An apparatus according to claim 1, characterised in that the air blades, the water rinsing and the vacuum tank can be actuated by means of a web tracking programme so that the apparatus can be switched on immediately upstream of the thickening in the layer transversely to the direction of travel of the web and can be switched off just after the end of the thickening.

4. An apparatus according to claim 3, characterised in that the web tracking programme and the switching on of the apparatus can be controlled by means of the moment and duration of the immersion and emergence of the coating device.

5. An apparatus according to claim 3, characterised in that the web tracking programme and the switching on of the apparatus can be controlled by means of a moisture content or layer thickness measuring device arranged upstream of the apparatus.

6. An apparatus according to claim 3, characterised in that the vacuum in the vacuum tank and the water supply can be switched on simultaneously with the air blades and can be switched off with a time delay after the switching off and pivoting out of the air blades.

7. An apparatus according to claim 1, characterised in that, for continuous operation of the apparatus, the vacuum tank is connected to a vacuum generating device which, in turn, can be evacuated via a jet suction device without interrupting the vacuum.

8. A method for removing thickenings in layers which are produced transversely to the direction of travel of the web on the web during the coating of photographic film and paper webs with photographic emulsions and layers, characterised in that the coated web is deflected by a web guide element and two air blades and air jets pointing towards each other are directed at a small angle $\alpha$ towards the layer of the web from below at the deflecting point which are actuated when thickenings appear in the layer and which scrape off the particles of the thickening in the layer and blow them into a vacuum tank which is sprinkled all over with water and which receives the particles, and the mixture of air, water and particles is supplied to a vacuum generating device which, in turn, is evacuated continuously by a jet suction device without interrupting the vacuum.

9. A method according to claim 8, characterised in that the air blades and air jets for scraping the thickening in the layer in a controlled manner just before the appearance of the thickening are brought to the deflecting point of the web and set into operation, wherein the vacuum tank is simultaneously provided with a vacuum and water sprinkling, the web is completely freed from the entire coating in the region of the thickening in the coating, and the air blades are firstly switched off and removed from the web after the end of the thickening in the layer and the vacuum and the water sprinkling are then switched off after a time delay.

* * * * *